US006712148B2

(12) United States Patent
Fipke et al.

(10) Patent No.: US 6,712,148 B2
(45) Date of Patent: Mar. 30, 2004

(54) JUNCTION ISOLATION APPARATUS AND METHODS FOR USE IN MULTILATERAL WELL TREATMENT OPERATIONS

(75) Inventors: Steven R. Fipke, Sherwood Park (CA); Ernest C. Bailey, Lake Dallas, TX (US); David J. Steele, Irving, TX (US); Travis W. Cavender, Angleton, TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 10/162,437

(22) Filed: Jun. 4, 2002

(65) Prior Publication Data

US 2003/0221843 A1 Dec. 4, 2003

(51) Int. Cl.[7] ..... E21B 43/12
(52) U.S. Cl. ..... 166/381; 166/50; 166/386
(58) Field of Search ..... 166/50, 117.6, 166/313, 380, 381, 386, 384, 117.5

(56) References Cited

U.S. PATENT DOCUMENTS

| | | | | |
|---|---|---|---|---|
| 2,728,395 A | | 12/1955 | Howard | |
| 2,894,588 A | | 7/1959 | Tausch et al. | |
| 3,361,204 A | | 1/1968 | Howard et al. | |
| 5,337,808 A | | 8/1994 | Graham | |
| 5,454,430 A | * | 10/1995 | Kennedy et al. | 166/50 |
| 5,474,131 A | * | 12/1995 | Jordan et al. | 166/313 |
| 5,715,891 A | | 2/1998 | Graham | |
| 5,941,307 A | | 8/1999 | Tubel | |
| 5,964,287 A | | 10/1999 | Brooks | |
| 5,971,073 A | | 10/1999 | Longbottom et al. | |
| 5,975,208 A | | 11/1999 | Brooks | |
| 5,992,525 A | | 11/1999 | Williamson et al. | |
| 6,062,306 A | | 5/2000 | Gano et al. | |
| 6,065,543 A | | 6/2000 | Gano et al. | |
| 6,092,602 A | | 7/2000 | Gano | |
| 6,119,771 A | | 9/2000 | Gano et al. | |
| 6,138,761 A | | 10/2000 | Freeman et al. | |
| 6,241,021 B1 | | 6/2001 | Bowling | |
| 6,354,375 B1 | * | 3/2002 | Dewey | 166/313 |

FOREIGN PATENT DOCUMENTS

| | | |
|---|---|---|
| EP | 0 701 045 A2 | 3/1996 |
| GB | 2332919 2 | 7/1999 |
| GB | 2333545 2 | 7/1999 |

OTHER PUBLICATIONS

Dresser Oil Tools Multilateral Completion Systems Sales Brochure, Undated.
European Search Report Application No.: GB 0119587.4.
Patent application USSN 09/637,494 filed Aug. 11, 2000, "Apparatus and Methods for Isolating a Wellbore Junction" (2000–IP–000292).
Patent aplication USSN 10/115,783 filed Apr. 4, 2002, "Apparatus and Methods for Isolating a Wellbore, Junction" (2000–IP–000292 U1P1 USA).
SPE 63268 "New Through–Tubing Junction–Isolation System Enables High–Pressure Stimulation in the Ekofisk X–02 North Sea Multilateral Well: Case History" dated; Oct. 2000.

* cited by examiner

*Primary Examiner*—Frank Tsay
(74) *Attorney, Agent, or Firm*—J. Richard Konneker; Marlin R. Smith

(57) ABSTRACT

Specially designed apparatus is utilized to provide convenient isolation of a wellbore junction from pressure and corrosion during an acid fracturing stimulation process performed in a main or branch wellbore portion downhole from the junction. The apparatus has an outer tubular portion which may be installed, in a single trip into the main wellbore, in a straddling and sealing relationship with the junction, and an inner tubular structure sealingly and removably received within the outer tubular structure. Fracturing acid may be pumped directly down the main wellbore, and then to the formation to be stimulated, via the interior of the outer tubular structure, after the removal of the inner tubular structure subsequent to its use in facilitating a downhole pressure test of a lower end seal portion of the outer tubular structure.

51 Claims, 5 Drawing Sheets

JUNCTION ISOLATION APPARATUS AND METHODS FOR USE IN MULTILATERAL WELL TREATMENT OPERATIONS

BACKGROUND OF THE INVENTION

The present invention generally relates to operations performed in conjunction with a subterranean well and, in an embodiment described herein, more particularly provides multilateral wellbore junction isolation apparatus and associated well stimulation methods.

Wellbore junctions are formed at intersections of wellbores in a subterranean well. For example, a main or parent wellbore may have a branch or lateral wellbore drilled extending outwardly from an intersection between the main and branch wellbores. Of course, the main wellbore may extend below the intersection with the branch wellbore, for example, to intersect a formation from which it is desired to produce hydrocarbons into the main wellbore.

Unfortunately, however, some wellbore junctions are not able to withstand substantial internal pressure applied thereto. For this reason, pressure within these wellbore junctions is limited to the fracture gradients of the respective formations in which the wellbore junctions are positioned. Thus, if stimulation operations, such as fracturing, must be performed for formations downhole of the wellbore junctions, expensive, time-consuming and/or complicated procedures must be used to prevent exceeding the fracture gradients of the formations at the wellbore junctions. Moreover, if an acid fracturing stimulation method is being employed the wellbore junctions are also susceptible to corrosion damage from the fracturing acid if care is not taken to shield the junctions from such corrosive material.

Therefore, it would be quite desirable to provide apparatus and s methods for isolating a wellbore junction which are convenient and easily utilized, and which isolate the wellbore junction from fluid pressure applied through the junction, as well as the corrosive effects Of a fluid creating such pressure.

SUMMARY OF THE INVENTION

In carrying out principles of the present invention, in accordance with a preferred embodiment thereof, specially designed apparatus is provided for isolating a junction between first and second intersecting wellbores in a subterranean well. The apparatus is removably insertable in the well, in a single trip into the well, and is operative to create in the well a fluid flow passage sealingly straddling the junction and protecting the junction from a pressurized fluid, representatively a well treatment fluid such as a fracturing acid, forced into a portion of one of the first and second wellbores via the interior of a portion of the junction isolation apparatus.

In a preferred embodiment thereof, the junction isolation apparatus comprises an elongated generally tubular outer structure having first and second longitudinally spaced part upper and lower portions with first and second external sealing devices respectively disposed thereon, the second external sealing device having an outer surface through which a recess inwardly extends to the outer structure. An elongated generally tubular inner structure is coaxially, sealingly and removably received in the outer tubular structure, and a seal test fluid flow passage extends from the interior of the inner structure into the recess in the second external sealing device.

Preferably, the first external sealing device is a packer having unset and set orientations in which the packer respectively precludes and permits the removal of the inner tubular structure from the outer tubular structure, and the second external sealing device comprises a longitudinally spaced plurality of annular sealing members circumscribing a lower end portion of the outer tubular structure. The first sealing device may be of an alternative structure, such as a seal bore portion of the wellbore casing, if desired. Also, the packer could be replaced by a non-sealing type of support structure, such as a hanger, with the function of the first sealing device being performed by, for example, a bridge plug run prior to setting a whipstock used to deflect the isolation structure into the second wellbore, or a packer run in conjunction with the whipstock.

A lower end portion of the inner tubular structure is blocked by, for example, a plug structure or check valve, and upper and lower end portions of the inner tubular structure respectively carry third and fourth external sealing devices which slidingly seal against the inner side surface of the outer tubular structure and are positioned at the top and bottom of an annulus defined between the inner and outer tubular structures. A sidewall opening in the inner tubular structure, and a sidewall opening disposed in the outer tubular structure at the second seal device recess, communicate with the annulus. The annulus and these sidewall openings form the previously mentioned seal test fluid flow passage.

To ready the junction isolation apparatus for use it is lowered into the well, representatively on a suitable work string structure anchored to the inner tubular structure, in a manner sealingly engaging the second external sealing device with an interior area of a selected one of (1) a portion of the first wellbore downhole from the junction and (2) a portion of the second wellbore, and positioning the packer adjacent an interior area of the first wellbore uphole of the junction. By flowing a suitable pressurized test fluid downwardly through the work string and, via the test fluid flow passage, into the recess of the second sealing device the second sealing may be conveniently pressure tested before the packer is set.

Upon a successful completion of this seal pressure test, the packer is set, thereby releasing the inner tubular structure from the outer tubular structure, and the work string is pulled out of the well, thereby also removing the inner tubular structure from the outer tubular structure and withdrawing the inner tubular structure from the well. The outer tubular member is thus left in place within the well, with the interior of the outer tubular member defining a fluid flow path that, at its upper end, communicates with substantially the entire cross-sectional area of an upwardly adjacent longitudinal portion of the first wellbore, and at its lower end communicates with the interior of the selected wellbore portion. This fluid flow path straddles and is sealingly isolated from the wellbore junction.

A wellbore treatment process, for example a fracturing/stimulation process, may then be carried out by pumping a pressurized well treatment fluid, such as a fracturing acid, downwardly through the full cross-sectional area of the first wellbore portion extending upwardly from the upper end of the remaining outer tubular member and, via the fluid flow path extending through the interior of the remaining outer tubular structure, into the selected wellbore portion. During this acid fracturing stimulation process the pressurized fracturing acid is isolated from the junction, to prevent pressure and/or corrosive damage thereto, and there is no return circulation flow of the stimulation fluid being forced into the selected wellbore portion.

The configuration and placement of the remaining outer tubular structure permits, as noted above, the well treatment to be downwardly flowed directly through the first wellbore portion disposed above the outer tubular member—i.e., through the entire cross-sectional area of such first wellbore portion. This advantageously reduces the pressure drop to which the flowing stimulation fluid is subjected and thus correspondingly facilitates higher stimulation fluid pumping rates. The configuration and construction of the overall isolation apparatus are quite simple, and the isolation apparatus may be installed in the well, and pressure-tested therein, with a single trip into the well. If the seal pressure test does not yield satisfactory results the entire isolation apparatus may be quickly and easily pulled out of the well for repair or refitting prior to the setting of the packer. After the stimulation or other well treatment process is completed, a suitable retrieval tool may be used to unset the packer and withdraw the outer tubular structure portion of the isolation apparatus from the well. Prior to its removal from the well the outer tubular member (when operatively extended into the second wellbore) may be conveniently utilized as a deployment tube through which a selected tool or other object may be lowered into the second wellbore to prevent interference between the lowered object and the junction area.

In an alternate embodiment thereof the junction isolation apparatus is provided with a modified outer tubular member having an enlarged upper longitudinal portion sized for coupling to a large diameter workstring which may be used to lower the junction isolation apparatus into the well, or be sealingly stabbed into the upper end of the outer tubular member after the junction isolation apparatus has been operatively positioned in the well by other means. During the stimulation process stimulation fluid is pumped downwardly through the workstring and operatively through the outer tubular member, thereby protecting the well casing from stimulation fluid pressure but still providing a substantially lowered stimulation fluid pumping pressure.

DETAILED DESCRIPTION

Figure 1:
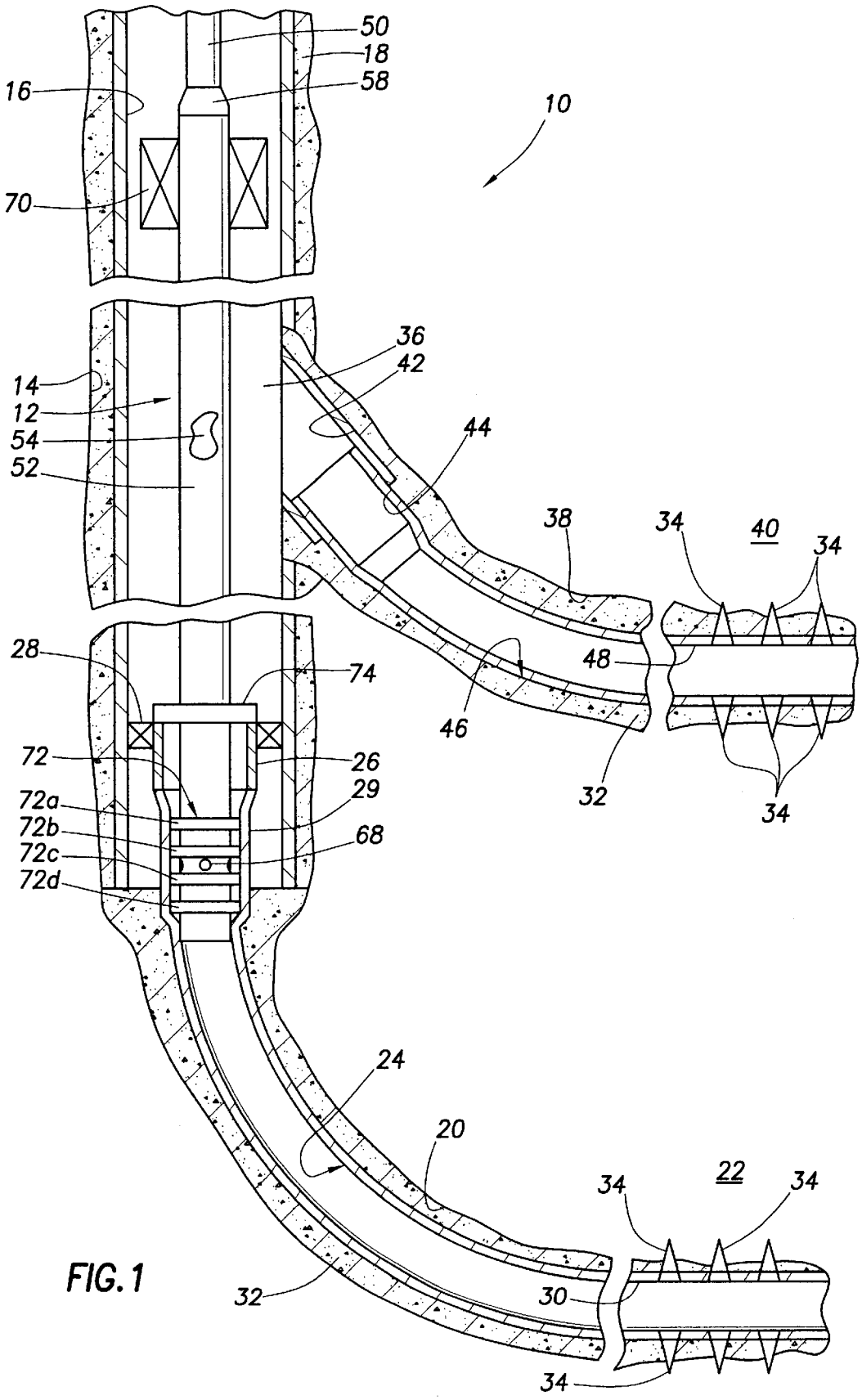
FIG. 1 is a schematic, longitudinally foreshortened cross-sectional view through a representative multilateral subterranean well illustrating the placement in one of its wellbores of a specially designed straddle stimulation structure embodying principles of the present invention and utilized to isolate a wellbore junction from fluid pressure and corrosion during an acid fracturing stimulation process.

Schematically depicted in cross-section in FIG. 1 is a representative subterranean multilateral well 10 which has been readied for a stimulation operation, representatively an acid fracturing operation, utilizing a specially designed isolation assembly, representatively in the form of a straddle stimulation structure 12 embodying principles of the present invention and subsequently described in detail herein.

In the following description of the well 10, and other apparatus and methods described herein, directional terms, such as "a bove", "below", "upper", "lower", etc., are used only for convenience in referring to the accompanying drawings. Specifically, the term "ab ove" is used herein to designate a direction toward the earth's surface (i.e., "uphole"), and the term "below" is used herein to designate a direction away from the earth's surface along a wellbore (i.e., "do wnhole"), even though the wellbore may not be substantially vertical. Additionally, it is to be understood that the various embodiments of the present invention described herein may be utilized in various orientations, such as inclined, inverted, horizontal, vertical, etc., and in various configurations, without departing from the principles of the present invention.

The representative multilateral well 10 illustrated in FIG. 1 has been constructed in a suitable conventional manner and has an illustratively vertical main wellbore section 14 with a tubular metal casing 16 cemented into the wellbore 14 as at 18. Forming a continuation of the lower end of the main wellbore 14 is a first lateral or branch wellbore 20 which turns outwardly in a generally horizontally direction and extends through a subterranean zone or formation 22 in which it is desired to perform a stimulation operation, such as acid fracturing, to thereby increase production of hydrocarbons therefrom. The wellbores 14 and 20 combinatively define a first wellbore portion of the multilateral well 10.

Extending through the branch wellbore 20 is a tubular liner 24 having an open upper end portion 26 sealed within a lower end portion of the main wellbore casing 16 by a schematically depicted annular seal structure 28, a polish bore portion 29 just beneath the upper end portion 26, and a horizontal lower end portion 30 extending through the formation 22 and having a suitable plug (not shown) at its outer end. Liner 24 is cemented into the branch wellbore 20 with cement 32 which is representatively an acid soluble cement. To facilitate a subsequent acid fracturing or other stimulation or treatment operation in the formation 22, perforations 34 have been formed through the liner portion 30 and the cement 32 into the formation 22 by, for example, utilizing a perforating gun (not shown) lowered into the liner section 30, detonated, and then withdrawn from the well 10.

Intersecting the main wellbore 14 at a junction area 36 disposed above the upper end of the first branch wellbore 20 is a second lateral or branch wellbore 38 that turns outwardly from the main wellbore 14 in a generally horizontal direction and extends through a subterranean zone or formation 40 in which it is desired to perform a stimulation operation, such as acid fracturing, to thereby increase production of hydrocarbons therefrom.

Extending outwardly through the junction area 36 is a tubular transition joint 42 outwardly circumscribing a polish bore portion 44 of a tubular liner 46 extending through the second branch wellbore 38 and having a horizontal lower end portion 48 passing through the formation 40 and having a suitable plug (not shown) at its outer end. Liner 46 and the transition joint 42 are cemented into the branch wellbore 38 with cement 32. To facilitate a subsequent acid fracturing stimulation operation in the formation 40, perforations 34 have been formed through the liner portion 48 and the cement 32 into the formation 40 by, for example, utilizing a perforating gun (not shown) lowered into the liner section 48, detonated, and withdrawn from the well 10.

Figure 1A:
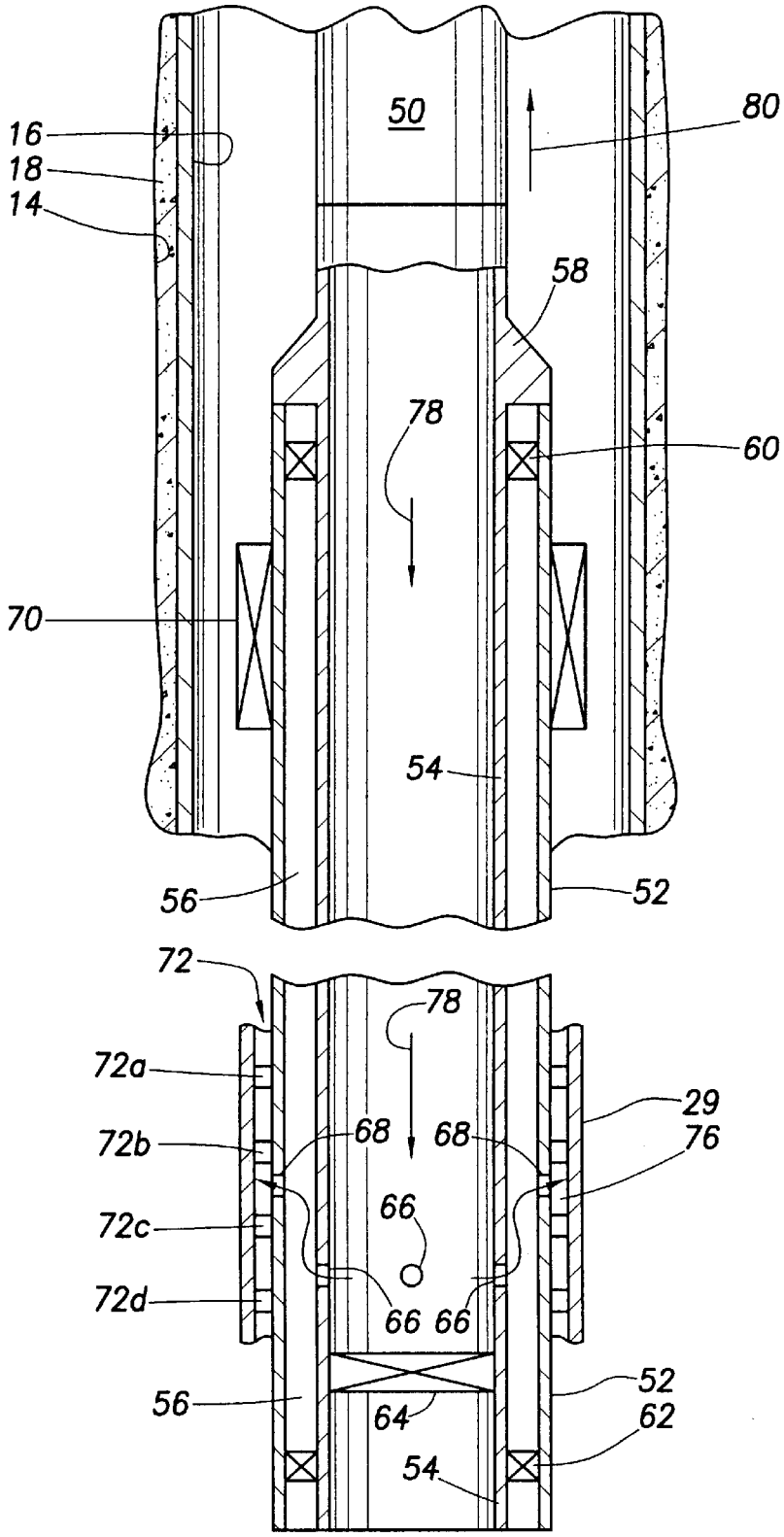
FIG. 1A is an enlarged scale, longitudinally foreshortened cross-sectional view through the straddle stimulation structure during seal pressure testing thereof prior to initiation of the acid fracturing stimulation process.

With the multilateral well 10 constructed in this conventional manner and representatively readied for an acid fracturing type stimulation operation, the specially designed straddle stimulation structure 12 is utilized in a manner which will now be described to isolate and protect the junction area 36 from damage from the high pressure and corrosiveness of the stimulation fluid. Referring now to FIGS. 1 and 1A, the straddle stimulation structure 12 is operatively deployed in the well 10, in a single trip down the main wellbore 14, by lowering it through the main wellbore 14 on a suitable tubular work string 50. For purposes of initial discussion it will be assumed that the straddle stimulation structure 12 is to be utilized to carry out an acid fracturing stimulation operation in the lower formation 22.

Still referring to FIGS. 1 and 1A, the straddle stimulation structure 12 includes an elongated, open-ended outer tubular member 52, and an elongated, open-ended inner tubular member 54 coaxially extending through the outer member 52 and forming therewith an annular space 56 positioned therebetween. AS illustrated, a laterally enlarged upper end portion 58 of the inner tubular member 54 overlies the open upper end of the outer tubular member 52 and is suitably anchored to the lower end of the work string 50. Externally carried respectively on upper and lower end portions of the inner tubular member 54 are annular seal members 60 and 62 (see FIG. 1A) which slidingly and sealingly engage the interior side surface of the outer tubular member 52 and thereby sealingly block off upper and lower ends of the annular space 56.

Disposed within a lower end portion of the inner tubular member 54 is a schematically depicted blocking structure 64 which is representatively a fixed plug member, but may alternatively be, for example, a velocity check valve structure or a removable plug member. Somewhat above the blocking structure 64 are a circumferentially spaced plurality of sidewall outlet ports 66 formed in the inner tubular member 54 and positioned below a circumferentially spaced plurality Of sidewall outlet ports 68 formed in the outer tubular member 52.

Figure 2:
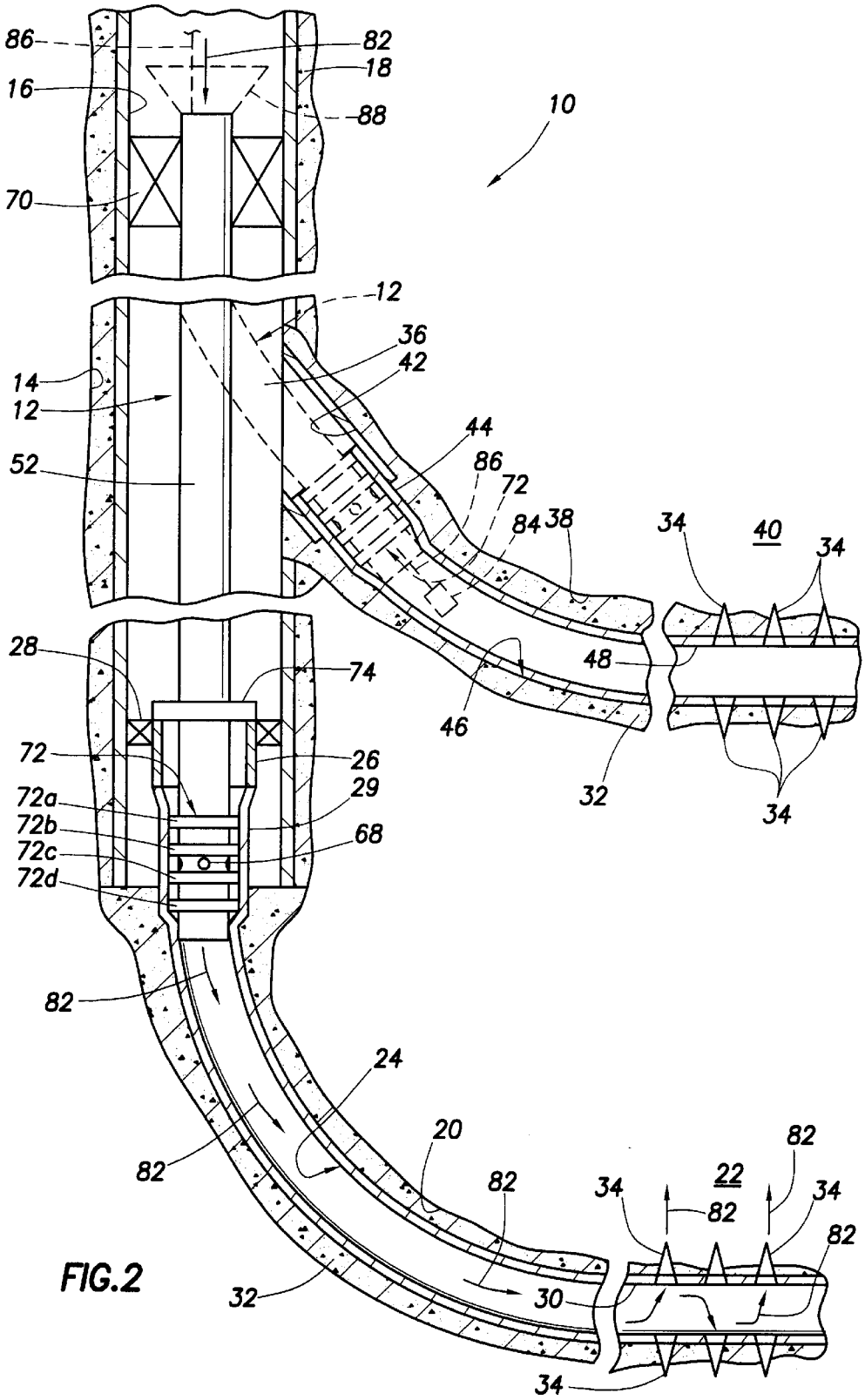
FIG. 2 is a view similar to that of FIG. 1, but illustrating the performance of the acid fracturing stimulation process.
Figure 2A:
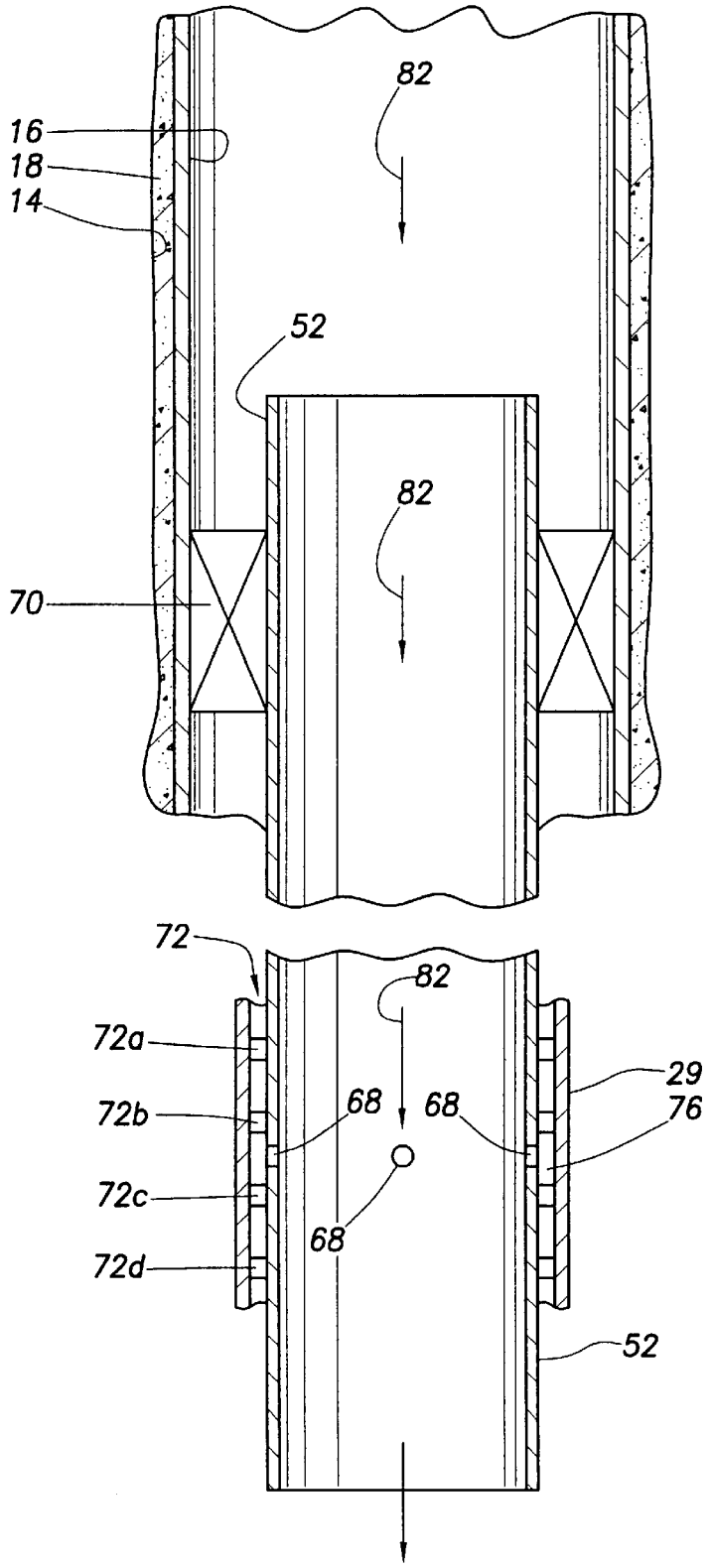
FIG. 2A is a view similar to that of FIG. 1A, but with fracturing acid being operatively forced through the interior of an outer tubular portion of the straddle stimulation structure.

An annular upper external sealing device 70 is externally carried on an upper end portion of the outer tubular member 52, and an annular lower external sealing device 72 is externally carried on a lower end portion of the outer tubular member 52. Illustratively, the upper sealing device 70 is a VERSA-TRIEVE® packer as manufactured by Halliburton Energy Services, Inc. of Duncan, Okla. The packer 70, when in an unset orientation (as shown in FIGS. 1 and 1A) is used in a conventional, well known manner to prevent the removal of the inner tubular member 54 from the outer tubular member 52. However, when the packer 70 is subsequently set (as schematically depicted in FIGS. 2 and 2A) within the main wellbore 14, the packer 70 releases the inner tubular member 54 from the outer tubular member 52. A no-go sub structure 74 (see FIG. 1) is carried by the outer tubular member 52 somewhat above the external annular sealing device 72.

The lower external sealing device 72, as illustrated in FIGS. 1 and 1A, representatively comprises a plurality of axially spaced annular resilient seal members 72*a*,72*b*,72*c*, 72*d* externally carried on a lower end portion of the outer tubular member 52, with the sidewall outlet ports 68 in the outer tubular member 52 being disposed between the annular seal member pair 72*b*,72*c*.

With continuing reference to FIGS. 1 and 1A, to stimulate the subterranean formation 22 representatively using an acid fracturing process, the straddle stimulation structure 12, with its packer 70 in an unset orientation, is lowered through the main wellbore 14 on the work string 50 until the seal structure 72 sealingly stabs into the liner seal bore portion 29 and the no-go structure 74 abuts the upper end of the liner portion 26. As can be best seen in FIG. 1A, this communicates the annular space 56 within the straddle stimulation structure 12 with a sealed-off annular space 76 bounded by the outer tubular member 52, the liner seal bore portion 29, and the annular seal elements 72*b*,72*c*.

According to one aspect of the present invention, this permits the lower seal structure 72 to be pressure tested prior to the setting of the packer 70. Thus, if leakage around the seal structure 72 is detected, the straddle stimulation structure 12 may simply be pulled out of the well 10 on the work string 50 in a simple and rapid manner and repaired or refitted as necessary. To test the in-place lower seal structure 72 prior to carrying out an acid fracturing stimulation process in the formation 22, a seal test fluid, representatively water 78, is pumped downwardly through the interiors of the work string 50 and the inner tubular member 54. The water 78 is forced outwardly through the inner tubular member sidewall ports 66 and into the seal annulus 76 via the sealed-off annulus 56 between the outer and inner tubular members 52,54. The water 78 is brought to a predetermined seal test pressure, and a predetermined seal test time is permitted to elapse.

If the pressure of the water 78 appreciably diminishes during the seal test period, leakage around the lower seal structure 72 is accordingly detected, and the straddle stimulation structure 12 may be rapidly and easily removed from the well 10 as described above for seal repair or refitting. On the other hand, if the pressure of the water 78 does not appreciably drop during the seal test period, the lower seal structure 72 passes its pressure test, and the acid fracturing stimulation of the formation 22 is initiated as will now be described in conjunction with FIGS. 2 and 2A.

Upon successful completion of the lower seal pressure test, the packer 70 is set to thereby sealingly engage with the interior side surface of the casing 16, thereby locking the upper end of the outer tubular member 52 within the casing 16 and releasing the inner tubular member 54 from the outer tubular member 52. AS indicated by the arrow 80 in FIG. 1A, the work string 50 is then pulled upwardly out of the main wellbore 14 bringing the now freed inner tubular member 54 with it. This leaves the outer tubular member portion 52 of the straddle stimulation structure 12 in place within the main wellbore 14, with the lower seal structure 72 still sealingly engaged with the polish bore portion 29 of the liner 24.

Fracturing acid 82 (see FIGS. 2 and 2A) is then downwardly pumped directly through the casing 16 and into the liner 24 via the interior of the outer tubular member 52. Pressurized acid 82 entering the liner 24 is forced outwardly through the perforations 34 into the formation 22 to fracture it and thereby stimulate its subsequent production rate. During this formation stimulation process there is no return flow of the stimulating fluid.

The ability, provided by the unique configuration and operation of the straddle stimulation structure 12 described above, to pump the fracturing acid 82 (or other stimulation or well treatment fluid as the case may be) directly through the casing (i.e., utilizing the full interior cross-sectional area of the main wellbore 14 as a stimulation fluid flow area), as opposed to having to pump stimulation fluid downwardly through smaller diameter auxiliary tubing extending through the main wellbore 14, desirably provides lower stimulation fluid pressure drops and permits higher stimulation fluid flow rates.

According to a key aspect of the present invention, during this downflow of pressurized fracturing acid 82, the wellbore junction area 36 is sealingly isolated and protected from contact by such acid flow and damage thereby from either its pressure or its corrosiveness. AS can best be seen in FIG. 2, the outer tubular member 52 defines an acid flow path which sealingly straddles and is isolated from the junction area 36.

AS will be readily be appreciated by those of ordinary skill in this particular art, leakage in the lower seal structure 72 could permit pressurized acid 82 to move upwardly through the casing 16, around the tubular member 52 and contact the junction area 36. However, the previously described method for testing the lower seal structure 72 substantially eliminates the possibility of this undesirable contact with the junction area 36 in a quick and easy manner.

After the acid fracturing stimulation of the formation 22 is carried out as described above, the packer 70 can be unset, and the in-place balance of the straddle stimulation structure 12 (i.e., the remaining outer tubular member 52) can be pulled out of the well 10 and the well 10 prepared for production in a suitable conventional manner.

The illustrated packer 70 could alternatively be one of a variety of other types of sealing devices such as, for example, a seal bore portion of the casing 16, or could be a non-sealing type of support structure such as a hanger device. In this latter case the provision of a sealing structure between the outer tubular member 52 and the casing 16 above the junction 36 could be effected using a sealing device which is not carried by the member 52 such as, for example, a bridge plug run prior to setting a whipstock (not shown) used to divert the member 52 into the lateral wellbore 38, or a packer rung in conjunction with the whipstock.

While the straddle stimulation structure 12 has been illustrated and described herein as being utilized in the acid fracturing stimulation of the formation 22 associated with the lower branch wellbore 20, it can of course also be used in conjunction with the acid fracturing stimulation of the upper formation 40 associated with the upper branch wellbore 38, while at the same time isolating the junction area 36 from contact by the pressurized acid. This alternate use of the straddle stimulation structure 12 is effected by simply lowering the structure 12 into the main wellbore 14 and then, instead of stabbing the lower seal portion 72 of the structure 12 into the lower liner 24 as previously described herein, suitably deflecting the structure 12 into sealing engagement with the seal bore portion 44 of the upper liner 46 as indicated in phantom in FIG. 2. The acid fracturing of the formation 40 may then carried out in a manner previously described herein for the formation 22. Alternatively, of course, the fracturing or other treatment of the formation 40 may be carried out before the fracturing or other treatment of the formation 22 if desired.

Referring again to FIG. 2, after the stimulation of zone 40, the outer tubular member 52 may be conveniently be used as a deployment tube structure through which an object, such as the tool 84, may be lowered through the outer tubular structure 52 into the lateral wellbore 38 using a suitable lowering structure such as a wireline 86, tubing string or the like. To facilitate the entry of the tool 84 into the open upper end of the tubular structure 52 such upper end may be provided with a funnel-like configuration as at 88.

As previously described herein, an advantage provided by the use of the straddle stimulation structure 12 is the ability to pump fracturing or other well stimulation or treatment fluid downwardly through the entire cross-sectional area of the casing 16. However, in some instances it may be desirable or necessary not to pump pressurized fluid directly through the casing, but to pump the fluid through the straddle stimulation structure via an alternate flow route which protects the casing 16 from the pressure of the treatment or stimulation fluid being downwardly pumped.

Figure 3:
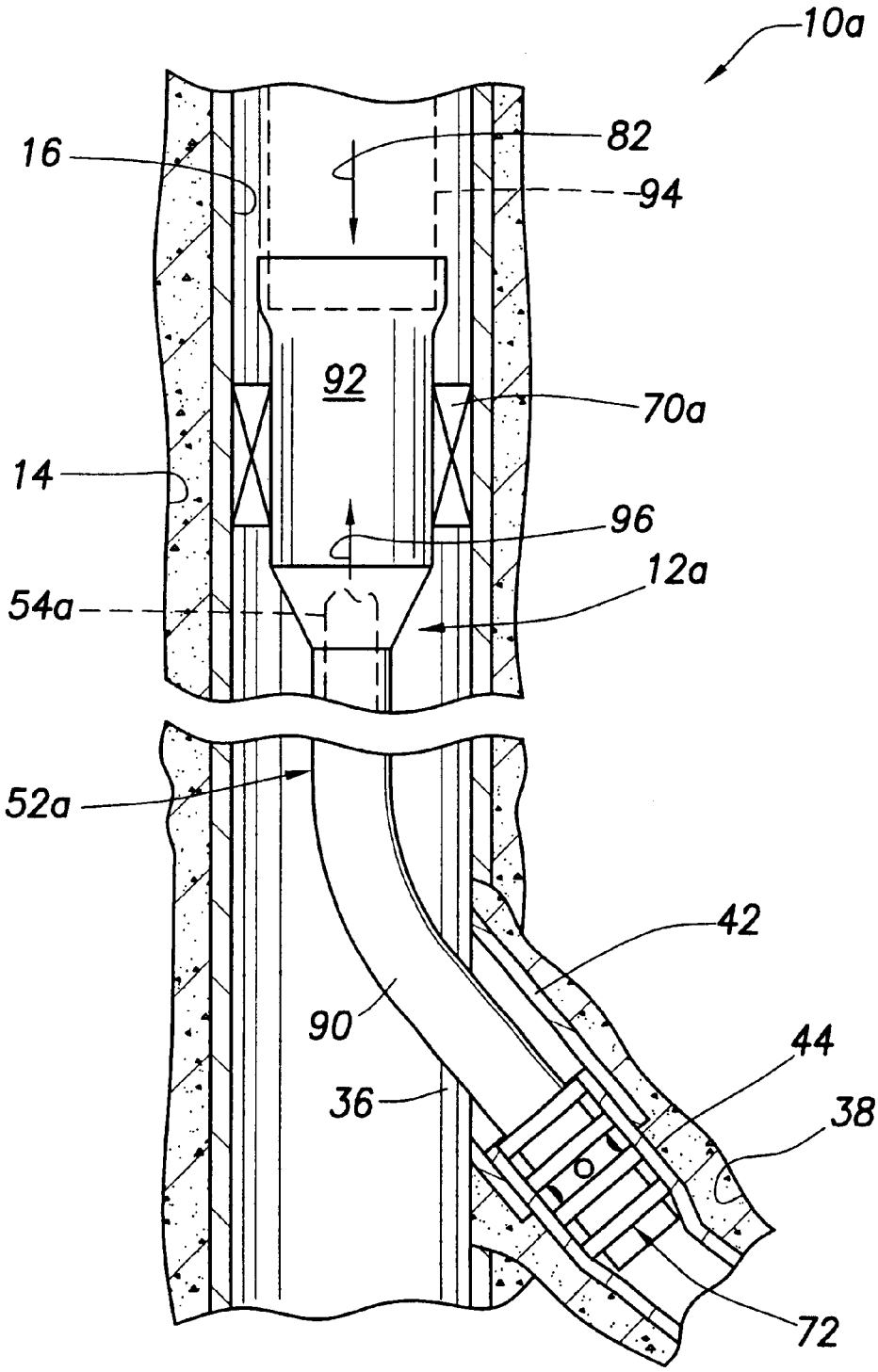
FIG. 3 is a schematic, longitudinally foreshortened cross-sectional view through an alternate embodiment of the straddle stimulation structure.

To accommodate this situation, while at the same time providing desirably lowered pumping pressure drops for the stimulation or other treatment fluid, the present invention provides, as schematically depicted in FIG. 3, an alternate embodiment 12*a* of the previously described straddle stimulation structure 12. For the purpose of facilitating comparison of the structures 12 and 12*a*, components in the structure 12*a* similar to those in structure 12 have been given identical reference numerals having the subscripts "a".

Turning now to FIG. 3, the straddle stimulation structure 12*a* has a modified outer tubular member 52*a* which has a lower longitudinal portion 90 with a diameter identical to the diameter of the previously described outer tubular member 52, and an upper longitudinal portion 92 having a substaritially larger diameter. As an example, but not by way of limitation, the casing 16 has a 7" diameter, the lower longitudinal portion 90 has a 3.688" diameter, and the upper longitudinal portion 92 has a 4.5" diameter and has an open upper end sized to sealingly receive a lower end portion of a similarly sized tubular workstring 94 which is shown in phantom in FIG. 3.

To use the modified straddle stimulation structure 12*a*, it is suitably positioned within the well (representatively extending into the lateral wellbore 38) and has its lower seal structure 72 pressure tested as previously described in conjunction with the straddle stimulation structure 12. The inner tubular member 54*a* is then removed from the outer tubular member 52*a* as indicated by the arrow 96 in FIG. 3. The workstring 94 is then lowered downwardly through the wellbore 14 and sealingly stabbed into the open upper end of the remaining outer tubular member 52*a*, and pressurized stimulation fluid, such as the fracturing acid 82, is pumped downwardly through the workstring 94 and into the lateral wellbore 38 via the interior of the outer tubular member 52*a*. The workstring 94 and the outer tubular member 52*a* can then be removed from the well.

As an alternative to stabbing the workstring 94 into the upper end of the outer tubular member 52*a* after the straddle stimulation structure 12*a* has been set in the well, its lower seal structure 72 pressure tested, and its inner tubular structure 54*a* removed, the modified straddle stimulation structure 12*a* can simply be lowered into place on the lower end of the workstring 94. The lower seal structure 72 can then be pressure tested by flowing a seal test fluid downwardly through the workstring 94. The inner tubular structure 54*a* can then be removed upwardly through the interior of the workstring 94, and stimulation fluid 82 pumped downwardly through the workstring 94. The workstring 94 and the remaining outer tubular member 52*a* can then be lifted out of the well. As will be appreciated by those of skill in this particular art, it is not mandatory that the straddle stimulation structure 12*a* have a lower seal structure, or to test such lower seal structure, when the straddle stimulation structure is used only to deploy a tool into the lateral bore 38 as previously described herein.

While the straddle stimulation structures 12 and 12*a* have been representatively described herein as being utilized in conjunction with an acid fracturing stimulation process, it will readily be appreciated by those of ordinary skill in this particular art that they could also be used to advantage with other well treatment or stimulation fluids, Such as water. Additionally, the various wellbore portions 14, 20 and 38 have been representatively depicted herein as being cased or lined, but it is to be clearly understood that the principles of the invention may be incorporated into other methods performed in uncased or unlined wellbores. Furthermore, the principles of the invention are not limited to wellbore junctions formed between main and branch wellbores. Also, while the drawings representatively depict a TAML level 4 junction construction, the junction isolation apparatus and methods illustrated and described herein could also be utilized in conjunction with a TAML level 2, 3, 5 or 6 junction construction if desired.

The foregoing detailed description is to be clearly understood as being given by way of illustration and example only, the spirit and scope of the present invention being limited solely by the appended claims.

What is claimed is:

1. For use in a subterranean well, a method of isolating a junction between a first wellbore and second wellbore extending outwardly from the first wellbore, the method comprising the steps of:

providing an elongated assembly including an outer, generally tubular structure having longitudinally spaced first and second external sealing devices thereon, and an inner, generally tubular structure coaxially and removably received in the outer structure;

positioning the assembly in the well with the first sealing device disposed within a first area in the first wellbore uphole of the junction, and the second sealing device sealingly engaged with a second area of a selected one of (1) a portion of the first wellbore downhole from the junction and (2) a portion of the second wellbore;

testing the second sealing device by flowing a seal test fluid in a downhole direction through the inner structure and outwardly through the sealingly engaged second sealing device; and sealingly engaging the first sealing device with the first area.

2. The method of claim 1 wherein:

the first external sealing device is a packer movable between set and unset positions, and the sealingly engaging step is performed by moving the packer from its unset position to its set position.

3. The method of claim 2 wherein:

the packer, in its unset position, locks the inner structure within the outer structure and, in its set position, permits the removal of the inner structure from the outer structure.

4. The method of claim 1 wherein:

in the positioning step the second sealing device is sealingly engaged with the second area of the portion of the second wellbore, and the method further comprises the step, performed after the removing step, of lowering an object through the outer tubular structure into the second wellbore.

5. The method of claim 1 further comprising the step of:

removing the inner structure from the outer structure and the well, whereby the remaining outer structure sealingly straddles the junction and interiorly defines a fluid flow path isolated therefrom.

6. The method of claim 5 wherein:

the second external sealing device includes a longitudinally spaced plurality of annular sealing members coaxially circumscribing the outer member, the outer structure has a sidewall opening disposed between an adjacent pair of the annular sealing members, and the testing step includes the step of forcing seal test fluid outwardly through the sidewall opening.

7. The method of claim 6 wherein:

prior to the removing step the inner structure has longitudinally spaced third and fourth external seal devices secured thereto and sealingly and slidingly engaged with the interior side surface of the outer structure, an annulus longitudinally extending between the third and fourth external seal devices being defined between the inner and outer structures, an end portion of the inner structure downhole from the third and fourth external seal devices having a blocking structure disposed therein, and the inner structure having a sidewall opening communicating with the annulus, and the testing step is performed by sequentially flowing a seal test fluid through the inner structure, outwardly through the inner structure sidewall opening into the annulus, and then outwardly from the annulus through the outer structure sidewall opening to between the adjacent pair of the annular sealing members on the second external sealing device.

8. The method of claim 7 wherein:

the blocking structure is a fixed plug member.

9. The method of claim 7 wherein:

the blocking structure is a check valve.

10. The method of claim 5 further comprising the step, performed after the removing step, of:

flowing a well treatment fluid sequentially through a portion of the first wellbore above the fluid flow path, the fluid flow path, and then into the selected wellbore portion, the removing step permitting essentially the entire cross-section of the first wellbore portion above the fluid flow path to be utilized in flowing the well treatment fluid to the fluid flow path.

11. The method of claim 10 wherein:

the flowing step is performed using a fracturing fluid.

12. The method of claim 11 wherein:

the flowing step is performed using a fracturing acid.

13. A method of treating a subterranean well having a first wellbore and a second wellbore extending outwardly from the first wellbore at a junction between the first and second wellbores, the method comprising the steps of:

sealingly and removably engaging a first longitudinal portion of an elongated, open-ended, generally tubular structure with a first interior area of the first wellbore uphole of the junction, and sealingly and removably engaging a second longitudinal portion of the tubular structure with a second interior area of a selected one of (1) a portion of the first wellbore downhole from the junction and (2) a portion of the second wellbore, to thereby cause the interior of the tubular structure to define a fluid flow path sealingly straddling and isolated from the junction; and flowing a pressurized well treatment fluid sequentially in a downhole direction through essentially the entire cross-sectional area of a portion of the first wellbore extending uphole from the fluid flow path, and then into the selected wellbore portion via the fluid flow path.

14. The method of claim 13 wherein:

the step of sealingly engaging a first longitudinal portion is performed using a packer structure.

15. The method of claim 13 wherein:

the step of sealingly engaging a second longitudinal portion is performed using a seal structure including a longitudinally spaced plurality of annular seal members coaxially and externally carried on the second longitudinal portion of the tubular structure.

16. The method of claim 15 further comprising the step of:

communicating an annular space between an adjacent pair of the annular seal members with the interior of the tubular structure via a sidewall opening in the tubular member.

17. The method of claim 13 wherein:

the flowing step is performed using a fracturing fluid.

18. The method of claim 17 wherein:

the flowing step is performed using a fracturing acid.

19. The method of claim 13 wherein:

the step of sealingly engaging a second longitudinal portion is performed in a manner substantially preventing a return flow of well treatment fluid from the selected wellbore portion.

20. The method of claim 12 further comprising the step of:

configuring the tubular structure in a manner such that the fluid flow path occupies substantially the entire cross-sectional interior area of the tubular structure along its length.

21. For use in a subterranean well having a first wellbore and a second wellbore extending outwardly from the first wellbore at a junction between the first and second wellbores, apparatus operatively insertable into the well to create therein a fluid flow passage sealingly straddling the junction, the apparatus comprising:

an elongated first generally tubular structure having first and second longitudinally spaced apart portions with first and second external sealing devices respectively disposed thereon, the first external sealing device being sealingly engageable with an interior surface portion of the first wellbore, and the second external sealing device having an outer surface through which a recess inwardly extends to the first structure;

an elongated second generally tubular structure coaxially, sealingly and removably received in the first tubular structure; and a seal test fluid flow passage extending from the interior of the second structure into the recess in the second external sealing device.

22. The apparatus of claim 21 wherein:

the first external sealing device is a packer.

23. The apparatus of claim 22 wherein:

the packer is movable between an unset position in which the packer precludes removal of the second structure from the first structure, and a set position in which the packer permits removal of the first structure from the second structure.

24. The apparatus of claim 21 wherein:

the second external sealing device comprises a longitudinally spaced plurality of annular seal members coaxially circumscribing the second structure with the recess being disposed between an adjacent pair of the annular seal members.

25. The apparatus of claim 24 wherein:

the first structure has a sidewall opening that communicates with the recess and forms a portion of the seal test fluid flow passage.

26. The apparatus of claim 25 wherein:

the second structure has a sidewall opening that communicates with the first structure sidewall opening and forms a portion of the seal test fluid flow passage.

27. The apparatus of claim 26 wherein:

the second structure has longitudinally spaced third and fourth external sealing devices thereon which straddle the second structure sidewall opening, slidingly and sealingly engage the inner side surface of the first structure, and are positioned at opposite ends of an annulus disposed between the first and second structures, communicating the sidewall openings in the first and second structures and forming a portion of the seal test fluid flow passage.

28. The apparatus of claim 27 wherein:

the fourth external sealing device is positioned longitudinally below the third external sealing device, and an internal portion of the second structure below the fourth external sealing device is blocked.

29. The apparatus of claim 28 wherein:

the internal portion of the second structure is blocked by a plug structure.

30. The apparatus of claim 28 wherein:

the internal portion of the second structure is blocked by a check valve.

31. Subterranean well apparatus comprising:

a first wellbore;

a second wellbore extending outwardly from the first wellbore at a junction between the first and second wellbores; and a generally tubular structure having upper and lower ends, a fluid flow path interiorly extending longitudinally through the structure between its open upper and lower ends, an upper end portion sealingly and removably engaging a first interior area of the first wellbore uphole of the junction, and a lower end portion sealingly and removably engaging a second interior area of a selected one of (1) a portion of the first wellbore downhole from the junction and (2) a portion of the second wellbore to cause the fluid flow path to sealingly straddle the junction, the open upper end of the structure communicating the fluid flow path with substantially the entire cross-sectional area of an upwardly adjacent longitudinal portion of the first wellbore in a manner such that a treatment fluid may be flowed directly through substantially the entire cross-sectional area of the upwardly adjacent longitudinal portion of the first wellbore and into the selected wellbore portion, via the fluid flow path, without fluid recirculation from the selected wellbore portion.

32. The subterranean wellbore apparatus of claim 31 wherein:

the fluid flow passage is the sole fluid flow passage extending longitudinally through the interior of the structure.

33. The subterranean wellbore apparatus of claim 31 wherein:

the upper end portion of the structure carries a packer that sealingly and removably engages the first interior area.

34. The subterranean wellbore apparatus of claim 31 wherein:

the lower end portion of the structure carries a seal structure that sealingly and removably engages the second interior area, the seal structure including a longitudinally spaced plurality of annular seal members circumscribing the lower end portion.

35. The subterranean wellbore apparatus of claim 34 wherein:

the structure has a sidewall opening intercommunicating the interior of the structure with a space between an adjacent pair of the annular seal members.

36. The subterranean wellbore apparatus of claim 31 wherein:

the structure is installable in a single downhole trip.

37. The subterranean wellbore apparatus of claim 31 wherein:

the structure is lowerable through the first wellbore and laterally deflectable into the second wellbore.

38. For use in a subterranean well, a method of isolating a junction between a first wellbore and a second wellbore extending outwardly from the first wellbore, the method comprising the steps of:

providing an elongated assembly including an outer, generally tubular structure having upper and lower longitudinal portions, and an inner, generally tubular structure coaxially and removably received in the outer structure, the lower longitudinal portion Of the outer structure having an external sealing device thereon;

positioning the assembly in the well with the upper longitudinal portion of the outer structure disposed within a first area in the first wellbore uphole of the junction, and the external sealing device being sealingly engaged with a second area of a selected one of (1) a portion of the first wellbore downhole from the junction and (2) a portion of the second wellbore;

testing the external sealing device by flowing a seal test fluid in a downhole direction through the inner structure and outwardly through the sealingly engaged external sealing device; and creating a seal area between the upper longitudinal portion of the outer structure and the first area in the first wellbore.

39. The method of claim 38 further comprising the step of:

removing the inner structure from the outer structure and the well, whereby the remaining outer structure sealingly straddles the junction and interiorly defines a fluid flow path isolated therefrom.

40. The method of claim 39 wherein:

the positioning step is performed in a manner sealingly engaging the external sealing device with the second area of the portion of the second wellbore, and the method further comprises the step, performed after the removing step, of lowering an object through the outer tubular structure into the second wellbore.

41. A method of treating a subterranean well having a first wellbore and a second wellbore extending outwardly from the first wellbore at a junction between the first and second wellbores, the method comprising the steps of:

supporting an elongated, open-ended, generally tubular flow structure within the well, with a first longitudinal portion of the flow structure disposed within a first area of the first wellbore uphole of the junction, and a second longitudinal portion of the flow structure disposed within a second area of a selected one of (1) a portion of the first wellbore downhole from the junction and (2) a portion of the second wellbore, the first longitudinal portion of the flow structure having a substantially greater flow area that that of the second longitudinal portion;

causing the flow structure to define a fluid flow path sealingly straddling and isolated from the junction by forming a first seal between the flow structure and the first area and forming a second seal between the flow structure and the second area; and flowing a pressurized well treatment fluid sequentially in a downhole direction through a tubular supply structure sealingly engaged and in flow communication with the first longitudinal portion and extending therefrom to the surface through the first wellbore, and then into the selected wellbore portion through the flow structure.

42. The method of claim 41 wherein:

the step of forming a first seal is performed using a packer exteriorly carried by the first longitudinal portion of the flow structure.

43. The method of claim 41 wherein:

the step of forming a second seal is performed using a seal structure exteriorly carried on the second longitudinal portion of the flow structure.

44. The method of claim 41 further comprising the step, performed after the supporting step and prior to the flowing step, of:

sealingly stabbing a lower end portion of the tubular supply structure into the first longitudinal portion of the flow structure.

45. The method of claim 41 wherein:

the flowing step is performed using a workstring as the tubular supply structure.

46. The method of claim 41 wherein:

the flowing step is performed using a tubular supply structure having a flow area at least substantially equal to that of the first, longitudinal portion of the flow structure.

47. The method of claim 41 wherein:

the supporting step includes the step of lowering the flow structure into the well on the tubular supply structure.

48. The method of claim 41 wherein:

the method further comprises the step, performed prior to the flowing step, of testing the second seal.

49. The method of claim 48 wherein:

the testing step is performed using a tubular test structure removably disposed within the flow structure.

50. The method of claim 49 further comprising the step of:

removing the test structure from the flow structure prior to performing the flowing step.

51. The method of claim 50 wherein:

the supporting step includes the step of lowering the flow structure into the well on a tubular supply structure, and the removing step is performed by removing the test structure in an uphole direction through the supply structure.

* * * * *